US005797738A

United States Patent [19]

Wills

[11] Patent Number: 5,797,738

[45] Date of Patent: Aug. 25, 1998

[54] BURNER AND METHOD OF BURNING A FUEL

[76] Inventor: Brian James Wills, "Sandbourne", Stone Lane, Kinver, West Midlands, England

[21] Appl. No.: 592,193

[22] Filed: Jan. 26, 1996

[51] Int. Cl.[6] ..... F23D 11/44

[52] U.S. Cl. ..... 431/215; 431/2; 431/10; 431/351

[58] Field of Search ..... 431/215, 2, 10, 431/195, 198, 201, 351, 352, 353

[56] References Cited

U.S. PATENT DOCUMENTS

| | | | |
|---|---|---|---|
| 5,238,395 | 8/1993 | Schwartz et al. | 431/10 |
| 5,275,552 | 1/1994 | Schwartz et al. | 431/10 |
| 5,393,220 | 2/1995 | Conwels et al. | 431/10 |
| 5,562,437 | 10/1996 | Gauthier et al. | 431/10 |
| 5,580,237 | 12/1996 | Leger | 431/10 X |

FOREIGN PATENT DOCUMENTS

| | | |
|---|---|---|
| 2 012 414 | 2/1979 | United Kingdom . |
| 2 053 452 | 2/1981 | United Kingdom . |

*Primary Examiner*—Larry Jones
*Attorney, Agent, or Firm*—Fulwider Patton Lee & Utecht, LLP

[57] ABSTRACT

A burner has a plate (21) with small openings (22) leading a first portion of the combustion air to mix with fuel and larger openings (24) for leading a second portion of the combustion air to mix with the burning fuel downstream of the position where the first portion of the air mixes with the fuel. The smaller openings (22) are sufficiently small for boundary layer effects to influence the ratio of the first portion to the second portion of the combustion air as the temperature of the air changes.

15 Claims, 2 Drawing Sheets

BURNER AND METHOD OF BURNING A FUEL

BACKGROUND OF THE INVENTION

The present invention relates to the combustion of fuel in air.

The rate at which oxides of nitrogen are produced during the combustion of a fuel in air depends upon the conditions under which combustion takes place. These conditions may vary during use of a burner for a variety of reasons. For example, during start-up, the temperature of the burner and of the burning fuel and air will vary. During use, the rate at which fuel is supplied to the burner may be varied, depending upon the rate at which heat is to be released. In a case where a regenerator is used to extract heat from products of combustion and subsequently to transfer that heat to combustion air, the temperature of the combustion air which is mixed with the fuel varies during each cycle of operation.

While it is known in the construction of burner nozzles to make provision for a secondary air-flow surrounding the flame produced by the burner, such secondary air-flow has not been variable in such a manner as to regulate or reduce reproduction of oxides of nitrogen.

SUMMARY OF THE INVENTION

According to a first aspect of the invention, there is provided a method of burning a fuel in air comprising the steps of:

delivering the fuel to a mixing position;

dividing a stream of air into first and second portions;

directing the first portion to the mixing position to burn the fuel; and directing the second portion of the air to merge with the burning fuel and air downstream of the mixing position, wherein the ratio of the first portion to the second portion varies as the temperature of the stream of air varies.

Varying the ratio of first portion to the second portion as the temperature of the stream of air varies is of assistance in avoiding the generation of substantial quantities of oxides of nitrogen.

Variation of the ratio of the first portion of the air stream to the second portion in the air stream can be achieved conveniently by using, to divide the stream of air into the first and second portions, a structure which defines first and second means for controlling flow of air through the structure and comprising at least one first opening and at least one second opening respectively, wherein a minimum transverse dimension of said at least one first opening is sufficiently small for the structure progressively to throttle the first portion of said air flow relative to the second portion of said air flow as the temperature of the air rises.

To achieve progressive throttling of the air flow through the first opening or each of the first openings, use is made of the boundary layer present in the or each opening adjacent to the surface which defines that opening. Within the boundary layer, the behaviour of the air differs from the behaviour of the air which is not included in a boundary layer. The velocity at which air flows towards the mixing position within the boundary layer differs from the corresponding velocity outside the boundary layer. If the boundary layer present within the or each first opening represents a substantial proportion of the volume represented by the first opening, then the boundary layer effect on the air flow will be significant. The boundary layer effect is believed to vary with the temperature of the air sufficiently to cause a useful change in the ratio of the first portion of the air stream to the second portion of the air stream when the temperature of the air stream varies.

This useful result may be achieved when said minimum transverse dimension is not substantially more than 10 mm. By minimum transverse dimension is meant the diameter, in the case of a circular opening, and the shortest distance across the opening, in the case of a non-circular opening.

To avoid the boundary layer effect in the second flow controlling means changing in a way to compensate for the variations in the boundary layer effect in the first flow controlling means, the minimum transverse dimension of said at least one second opening is larger than the corresponding dimension said at least one first opening and/or the form of said at least one second opening differs from the form of said at least one first opening. For example, the second opening may have a flared upstream entry portion; whereas the first opening may have transverse dimensions which are uniform from the entry to the exit of the opening.

According to a second aspect of the invention, there is provided a burner for burning a fuel in air and comprising:

a wall member defining a mixing position for said fuel and air;

a conduit defining a fuel flow path for flow of fuel to the mixing position;

a chamber defining an air flow path through the burner;

dividing means for dividing a stream of air flowing along the air flow path into first and second portions;

said dividing means including a first flow control means for controlling flow through which said first portion of the air stream flows and second flow control means for controlling flow through which said second portion of the air stream flows, the first flow control means comprises at least one first opening each of which has a minimum transverse dimension not substantially more than 10 mm across, and the second flow control means comprising at least one second opening each of which has a minimum transverse dimension that is greater than that of said at least one first opening.

Either one or both of the first and second portions may comprise a plurality of streams of air which can be distinguished from each other.

The length of said at least one first opening, measured in the direction of air flow towards the mixing position, is preferably a plurality of times greater than said minimum transverse dimension thereof.

Preferably, the burner further comprises a wall which extends in the downstream direction relative to said air flow from said structure at a position between said at least one first opening and said at least one second opening.

According to a third aspect of the invention, there is provided a burner for burning a fuel in air and comprising:

means for defining a mixing position for said fuel and air;

means for defining a fuel flow path for flow of fuel to the mixing position;

means for defining an air flow path through the burner;

dividing means for dividing a stream of air flowing along the air flow path into first and second portions;

said dividing means including a first flow controlling means for controlling flow through which said first portion of the air stream flows and second flow controlling means for controlling flow through said which second portion of the air stream flows;

the first flow control means comprising at least one first opening;

the second flow control means comprising at least one second opening;

said first and second openings having dimensions different from each other; and a wall extending downstream from said means for dividing said air stream at a position between said first and second openings to separate said first portion of the air stream from said second portion of the air stream to a predetermined distance from said dividing means.

The wall preferably surrounds the path of the first portion of the air stream and may be convergent in a downstream direction.

The wall is preferably spaced substantially from the first opening and may be immediately adjacent to the second opening.

According to a fourth aspect of the invention, there is provided a burner for burning a fuel in air and comprising a wall surrounding a mixing position where burning fuel and air mix, wherein the wall is convergent in at least one of an upstream direction and a downstream direction with respect to flow of air to the mixing position and wherein the wall defines a plurality of slots which extend into the wall from either an upstream or a downstream extremity of the wall, each said slot extending through the entire thickness of the wall.

BRIEF DESCRIPTION OF THE DRAWINGS

An example of a burner embodying each of the second, third and fourth aspects of the invention and which is used in a method according to the first aspect will now be described, with reference to the accompanying drawings, wherein.

DESCRIPTION OF THE PREFERRED EMBODIMENTS

Figure 1:
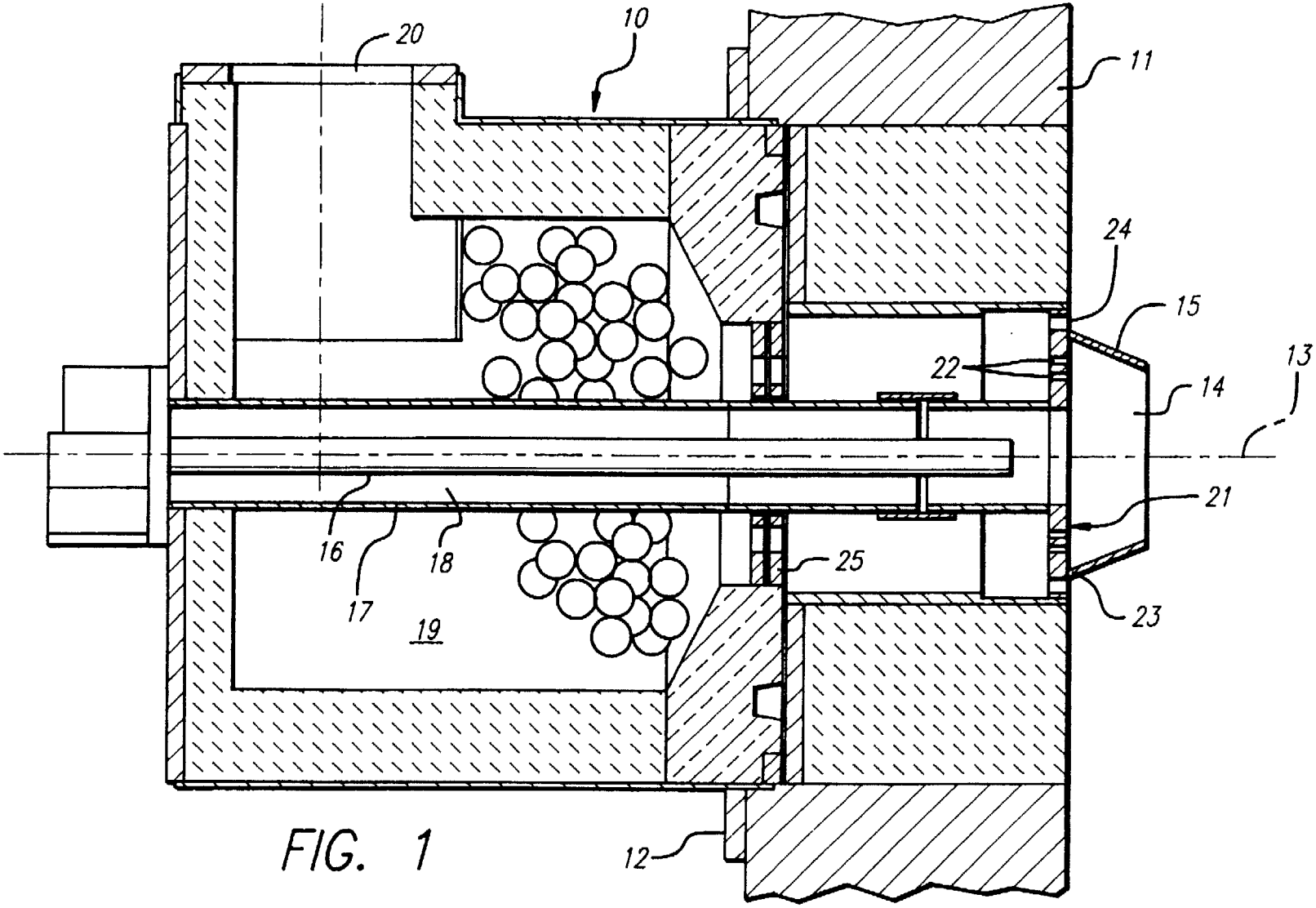
FIG. 1 shows a cross section of the burner in a plane containing an axis of the burner, together with an adjacent part of a furnace wall.

The burner illustrated in the accompanying drawing comprises a body 10 adapted for mounting in a hole defined by a furnace wall 11 with one portion of the burner occupying the hole substantially entirely and a further portion of the burner protruding from the wall at the outside of the furnace. The body includes a mounting flange 12 to facilitate attachment of the burner to the furnace wall. The body 10 defines an longitudinal axis 13 which extends through the hole of the furnace wall in a direction from outside the furnace to inside the furnace. Typically, the axis 13 will be perpendicular to a plane defined by an inner surface of a part of the furnace wall surrounding the burner.

The burner defines a mixing position 14 which is intersected by or lies close to the plane defined by the inner surface of that part of the furnace wall 11 which surrounds the burner. In the particular example illustrated, the mixing position is surrounded by an annular wall 15 of the burner. The wall 15 defines an opening centred on the axis 13 through which there is communication between the mixing position 14 and the chamber defined by the furnace.

The burner includes a fuel tube 16 which extends along the axis 13 from a position outside the furnace wall, where the fuel tube is connected with a supply of gaseous fuel, towards, but not to the mixing position 14. The fuel tube has an open end facing towards the mixing position. The fuel tube 16 is surrounded by a coaxial support 17 which is of larger diameter so that an annular passage 18 is provided between the tubes 16 and 17. Outside the support tube 17, the body 10 defines a chamber 19 containing a mass of heat storage bodies or a single heat storage body. The chamber 19 forms a part of an air flow path leading from an air inlet 20 to the burner towards the mixing position 14.

Adjacent to the mixing position 14, the air flow path through the chamber 19 terminates at a structure 21 which is suitable for dividing the air flow into first and second portions. The particular example of structure 21 represented in the accompanying drawings is a substantially flat, annular plate which is perpendicular to the axis 13 and has a central opening aligned with the passage 18 inside the support tube 17. This central opening of the plate preferably has a diameter which is at least approximately equal to the internal diameter of the support tube 17.

The annular wall 15 adjoins the plate 21 at a joint 23. A set of first openings 22 is formed in the plate 21 between the joint 23 and the central opening defined by the plate. A set of second openings 24 is formed in the plate further from the axis 13 than the joint 23.

In the particular example represented in the accompanying drawings, each of the first openings 22 is circular, as viewed in a direction along the axis 13, is rectilinear, as viewed in the cross section of FIG. 1, and is parallel to the axis 13. All of the first openings may lie at the same distance from the axis 13. Alternatively, some of the first openings may lie nearer to the axis than do others of the first openings. If required, some or all of the first openings may be inclined to the axis 13. Preferably, all of the first openings are spaced from the joint 23 in a direction towards the axis 13 a substantial distance, for example a distance exceeding the diameter of each first opening. The first openings are also spaced substantially from the central opening defined by the plate 21.

The second openings 24 lie near to the periphery of the plate 21 and occupy an annular region of the plate between the joint 23 and the periphery. In the particular example illustrated, these openings also are circular, as viewed in a direction along the axis 13, and are rectilinear, as viewed in the plane of FIG. 1. Each first opening may be parallel to the axis 13, as shown, or may be inclined to that axis. Preferably, each second opening is inclined to the adjacent external surface of the wall 15 at an angle which is sufficiently large to ensure that the air flowing through the second opening breaks away from the wall 15 and does not flow along that wall. To achieve this result, the second openings may be mutually divergent, in the downstream direction.

Each of the first openings 22 has a diameter such that flow of air through the opening is affected substantially by a boundary layer on the surface of the plate 21 which defines the opening. Accordingly, the diameter of each first opening is not substantially greater than 5 mm. The length of each first opening, measured along the axis 13, is at least twice the diameter of the opening and is preferably several times the diameter of the opening. For example, the length of each first opening may be 25 mm. The diameter of each first opening may be significantly less than 5 mm, for example around 2.5 to 3 mm, but in some cases may be up to about 10 mm.

Each first opening 22 is preferably cylindrical along its entire length. Immediately adjacent to the opening at both its entrance and exit, the adjacent surface of the plate 21 is preferably perpendicular to the longitudinal axis of the opening. Although not shown in the drawing, each second opening 24 preferably has a flared entrance to facilitate flow of air into the opening. Each second opening is larger than each of the first openings. In the example illustrated, each second opening is circular, as viewed along the axis 13, and has a diameter significantly greater than 5 mm so that boundary layer effects during flow of air through the second openings are much less significant than in the case of the first openings. For example, each second opening may have a diameter of 8 mm where the first opening is less than 5 mm across, and correspondingly more, where the first opening is larger.

The number of second openings 24 and the number of first openings 22 are selected to provide the air flow rates required. Typically, there are about 20 second openings and about 20 first openings in the plate 21. The first openings and the second openings are distributed evenly around the axis 13.

In a case where the chamber 19 contains a mass of heat storage bodies, a retainer 25 may be provided inside the body 10 to retain the heat storage bodies in positions spaced from the plate 21. Some of the heat storage bodies rest on the support tube 17. The burner is suitable for use in conjunction with a second burner firing into the same furnace chamber. When the second burner is firing, hot products of combustion are exhausted from the furnace chamber through the chamber 19 of the burner shown in the drawings and heat is transferred from those products of combustion to the heat storage bodies in the chamber 19. When the burner shown in the drawings is firing, air flows through the chamber 19 towards the mixing position 14 and receives heat from the heat storage bodies. At the plate 21, the heated stream of air is divided into a first portion which flows through the first openings 22 to the mixing position and a second portion which flows through the second openings 24. It will be noted that the second portion is separated from the mixing position by the annular wall 15. Gaseous fuel is fed towards the mixing position along the fuel tube 16. Air is fed at a relatively low rate along the annular passage 18 towards the mixing position. This flow of air cools the support tube 17 and avoids the temperature of the fuel tube 16 rising towards an unacceptable level. It will be noted that the open end of the fuel tube is somewhat upstream from the plate 21. Accordingly, mixing of the fuel with air from the annular passage 18 commences before the fuel reaches the mixing position which lies downstream of the plate 21.

A spark-ignition device (not shown) may be provided at the mixing position 14. Combustion takes place at the mixing position and downstream from the mixing position. Thus, there is established a flame extending from the burner into the furnace chamber. Air which flows through the second openings 24 mixes with the burning fuel in the furnace chamber downstream of the wall 15.

The rate at which air flows along the annular passage 18 is preferably in the region of 10% of the overall rate of flow of air through the burner.

It is believed that, as the temperature of air flowing to the plate 21 rises, the flow of air through the first openings 22 is progressively throttled by the boundary layer effect so that a smaller proportion of the overall air flow passes through the first openings 22 and a larger proportion passes through the second openings. It is believed that, when the temperature of the air flowing to the plate 21 falls, throttling of the first opening 22 by boundary layer effect decreases and the proportion of the overall air flow which passes through the first openings 22 increases. This is believed to facilitate the maintenance of stable flame of blue colour throughout, without leading to the production of oxides of nitrogen at a rate similar to the rates which result from the use of many known burners.

Whilst a wall 15 which is convergent in the downstream direction, when the burner is firing, is satisfactory, a substantially cylindrical wall or a wall having a part which diverges in a downstream direction may be provided in place of the wall 15 shown in the drawings.

It has been found that, when operating under a variety of conditions, use of the burner shown in the accompanying drawings enables fuel to be burned to produce a non-reducing furnace atmosphere with generation of oxides of nitrogen at a low rate, as compared with burners presently in use. This result is achieved without special steps, for example re-circulation of furnace gases or introduction of water through the burner.

The burner illustrated in the accompanying drawings may be modified for use with a liquid fuel. Such modification is achieved by substituting for the fuel tube 16 a fuel tube having at its end near to the mixing position a nozzle for delivering a liquid fuel and disrupting the liquid fuel into droplets. If required, means may be provided to deliver compressed air to the nozzle to facilitate disruption of the liquid fuel. Furthermore, means for maintaining a pilot flame adjacent to the nozzle may be provided. It will be noted that a burner generally as represented in the accompanying drawings is well suited for construction either as a burner for gaseous fuel or as a burner for a liquid fuel.

The burner may also be modified by extending up to the structure 21 the chamber 19 which contains the storage bodies. Thus, the wall 25 shown in the drawing and which retains the heat storage bodies may be omitted.

In use of the arrangement represented in FIG. 1, the part of the air flow which passes through the first openings 22 forms, downstream of those openings, what is essentially a single stream of air flowing through the space defined inside the wall 15 and mixing with the fuel. The air which flows through the second openings 24 forms what is essentially a single, second stream of air which flows around the outside of the wall 15 to merge with the burning fuel downstream of that wall. However, it would be possible to provide a greater number of essentially distinct air streams downstream of the plate 21. Thus, the second part of the overall air stream may be divided at the plate 21 into a plurality of air streams which are maintained separate from each other for a substantial distance downstream of the plate 21.

Figure 2:
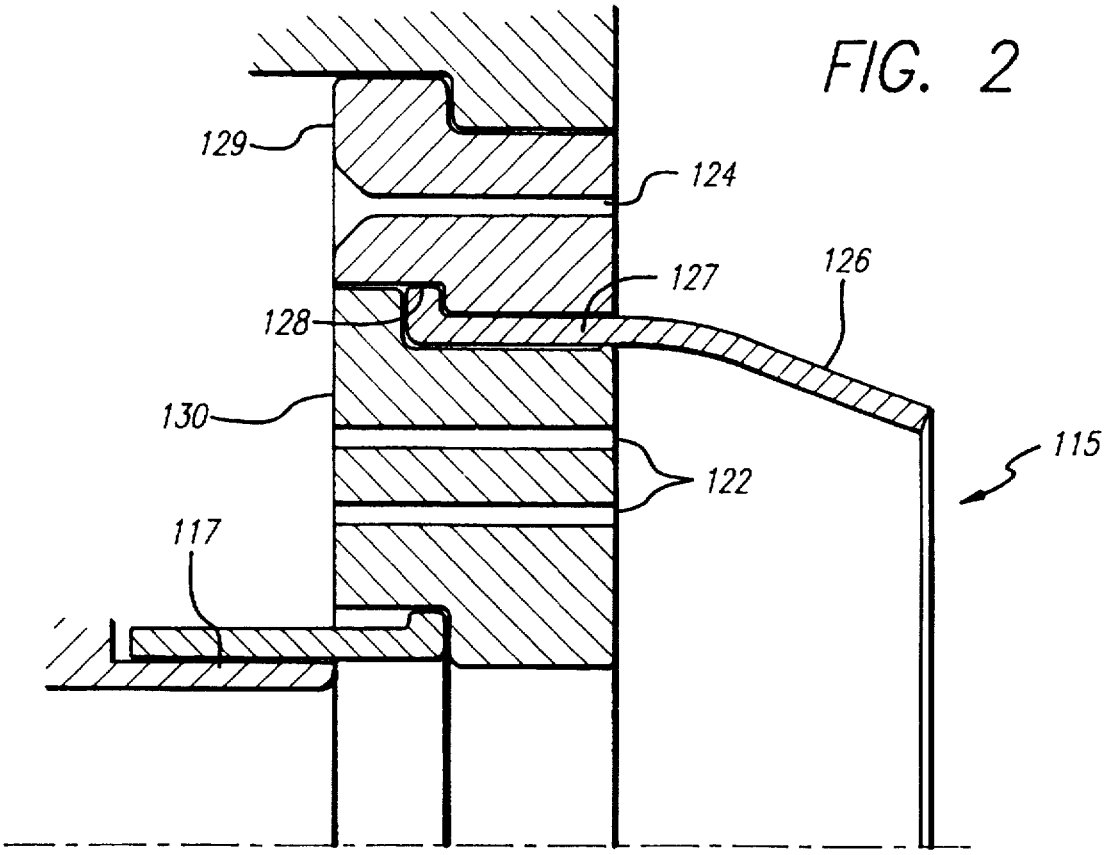
FIG. 2 illustrates, by a view similar to FIG. 1, a modification of the burner
Figure 3:
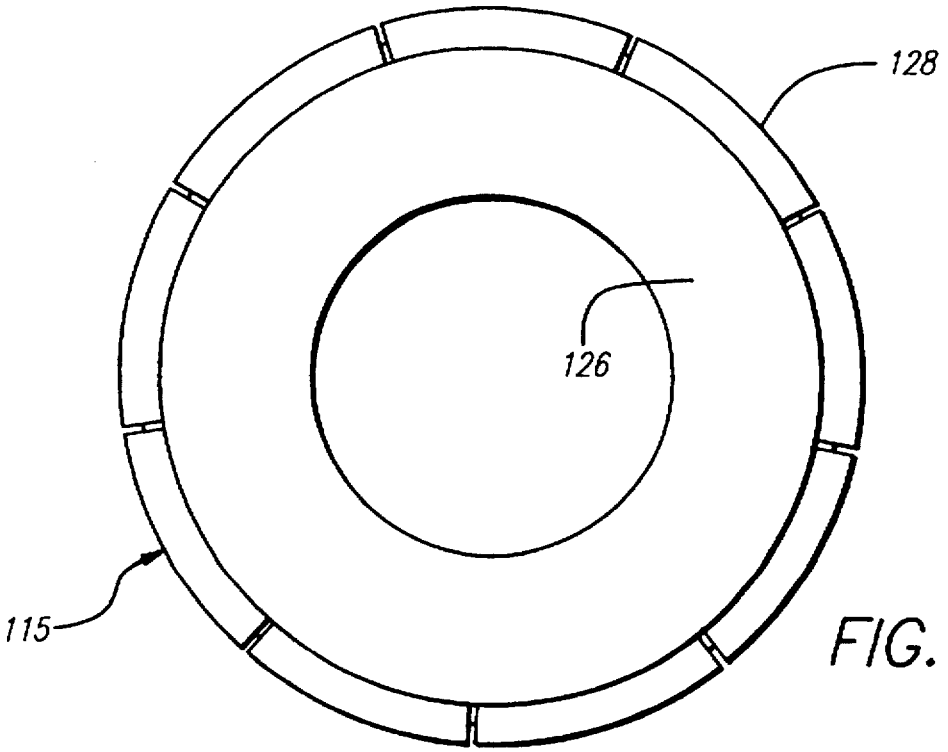
FIG. 3 shows an end view of a part of the modified burner of FIG. 2.

The wall 15 represented in FIG. 1 may be formed of metal and may be attached in a known manner to the plate 21. In FIGS. 2 and 3, there is represented a modification of the burner of FIG. 1, in which modification the wall corresponding to the wall 15 of FIG. 1 is formed of a ceramic material.

In FIGS. 2 and 3, parts corresponding to those hereinbefore described are identified by like reference numerals with the prefix 1. The preceding description is deemed to apply to such corresponding parts, except for differences herein after mentioned.

The wall 115 comprises a tapered, downstream portion 126 and a substantially cylindrical portion 127 which is upstream of the portion 126. At the end of the cylindrical portion 127 remote from the tapered portion, there is a radially outwardly projection rib 128.

The wall 115 is received in a stepped opening defined by an outer, annular block 129. The rib 128 seats on a shoulder of the block 129 and limits movement of the wall 115 in the downstream direction relative to the block. The block is seated in a similar way in an opening of the furnace wall. An inner, annular block 130 lies within the cylindrical portion 127 of the wall 115 and has a radially outwardly projecting portion which bears on the rib 128 and holds the rib on its seat in the outer block 129.

The inner block 130 defines a central opening through which fuel flows to the mixing position. The inner block also defines first openings 122 for flow of a first part of the combustion air. The outer block 129 defines second openings 124 for flow of the second part of the combustion air.

In the cylindrical portion 127 and the rib 128 of the wall 115, there is formed a number of slots which extend into the wall from the upstream extremity thereof and which extend through the entire thickness of the wall. These slots are believed to relieve thermal stresses in the wall sufficiently to avoid cracking of the wall in use. The wall 115 may be formed of silicon carbide. The inner and outer blocks 129 and 130 also may be formed of a ceramic material.

The features disclosed in the foregoing description, or the following claims, or the accompanying drawings, expressed in their specific forms or in terms of a means for performing the disclosed function, or a method or process for attaining the disclosed result, as appropriate may, separately or in any combination of such features, be utilised for realising the invention in diverse forms thereof.

I claim:

1. A method of burning a fuel in air, comprising the steps of:

delivering the fuel to a mixing position;

dividing a stream of air into first and second portions, said first portion passing through at least one first fixed opening having a minimum transverse dimension not substantially greater than 10 mm, and said second portion passing through at least one second fixed opening having a minimum transverse dimension different from the minimum transverse dimension of said at least one first opening, whereby the ratio of the first portion to the second portion varies as the temperature of the stream of air varies;

directing the first portion to the mixing position to burn the fuel; and directing the second portion of the air to merge with the burning fuel and air downstream of the mixing position.

2. A method according to claim 1, wherein the stream of air is divided into said first and second portions by a structure which defines a first means for controlling flow through which said first portion of the stream of air flows and a second means for controlling flow through which said second portion of the stream of air flows, and the first means for controlling flow progressively throttles said first portion of the air stream relative to said second portion of the air stream as the temperature of the air rises.

3. A method according to claim 2, further comprising the step of mixing an additional stream of air with the fuel before said first portion of the air stream is mixed with the fuel.

4. A method according to claim 1, wherein the second portion of the air stream is separated from the burning fuel and air at the mixing position by a wall.

5. A method according to claim 4, further comprising the step of mixing an additional stream of air with the fuel before said first portion of the air stream is mixed with the fuel.

6. A method according to claim 1, further comprising the step of mixing an additional stream of air with the fuel before said first portion of the air stream is mixed with the fuel.

7. A burner for burning fuel in air and comprising:

a wall member defining a mixing position for said fuel and air;

a conduit defining a fuel flow path for flow of fuel to the mixing position;

a chamber defining an air flow path through the burner;

a self-throttling annular plate for dividing a stream of air flowing along the air flow path into first and second portions;

said annular plate including a first fixed outlet portion through which said first portion of the air stream flows and a second fixed outlet portion through which said second portion of the air stream flows, the first outlet portion comprising at least one first opening having a minimum transverse dimension not substantially more than 10 mm across, and the second outlet portion comprising at least one second opening each of which has a minimum transverse dimension that is greater than that of said at least one first opening.

8. A burner according to claim 7, wherein said at least one first opening has a length, measured in the direction of said air flow, which is a plurality of times greater than said minimum transverse dimension thereof.

9. A burner according to claim 8, further comprising a wall which extends in the downstream direction relative to said air flow from said structure at a position between said at least one first opening and said at least one second opening.

10. A burner according to claim 9 wherein said at least one first opening is spaced substantially from said wall.

11. A burner for burner fuel in air and comprising:

means for defining a mixing position for said fuel and air;

means for defining a fuel flow path for flow of fuel to the mixing position;

means for defining an air flow path through the burner;

a self-throttling annular plate for dividing a stream of air flowing along the air flow path into first and second portion;

said annular plate including a first outlet portion through which said first portion of the air stream flows and a second outlet portion through which second portion of the air stream flow;

the first outlet portion comprising at least one first opening;

the second outlet portion comprising at least one second opening;

said first and second openings having dimensions different from each other and said at least one first opening having a minimum transverse dimension not substantially greater than 10 mm; and a wall extending downstream from said means for dividing said air stream at a position between said first and second openings to separate said first portion of the air stream from said second portion of the air stream to a predetermined distance from said annular plate.

12. A burner according to claim 11 wherein said wall surrounds the path of said first portion of the air stream.

13. A burner according to claim 12 wherein said wall is convergent in a downstream direction.

14. A burner according to claim 13 wherein said wall is spaced from said at least one first opening.

15. A burner for burning a fuel in air and comprising a wall surrounding a mixing position where burning fuel and air mix, wherein the wall is convergent in a downstream direction and an annular plate defining a plurality of self-throttling slots which extend through the entire thickness of the annular plate.

* * * * *